United States Patent [19]

Feuer et al.

[11] Patent Number: 4,960,276

[45] Date of Patent: Oct. 2, 1990

[54] CROSS COUNTRY SKI EXERCISE APPARATUS

[75] Inventors: Mark S. Feuer, Boulder; Eugene P. Smith, III, Westminster, both of Colo.

[73] Assignee: Fittraxx, Inc., Boulder, Colo.

[21] Appl. No.: 360,293

[22] Filed: Jun. 2, 1989

[51] Int. Cl.[5] ..... A63B 23/00

[52] U.S. Cl. ..... 272/97; 272/70

[58] Field of Search ..... 272/70, 97; 128/25 R, 128/25 B; 434/253

[56] References Cited

U.S. PATENT DOCUMENTS

| | | | |
|---|---|---|---|
| 1,016,729 | 2/1912 | Barrett . | |
| 2,646,282 | 7/1953 | Ringman . | |
| 2,969,060 | 1/1961 | Swanda et al. . | |
| 3,213,852 | 10/1965 | Zent | 272/73 |
| 3,940,128 | 2/1976 | Ragone | 272/73 |
| 3,941,377 | 3/1976 | Lie . | |
| 4,023,795 | 5/1977 | Pauls . | |
| 4,402,506 | 9/1983 | Jones . | |
| 4,434,981 | 3/1984 | Norton . | |
| 4,512,571 | 4/1985 | Hermelin | 272/126 |
| 4,529,194 | 7/1985 | Haaheim . | |
| 4,618,139 | 10/1986 | Haaheim . | |
| 4,632,385 | 12/1986 | Geraci . | |
| 4,659,077 | 4/1987 | Stropkay | 272/97 |
| 4,679,786 | 7/1987 | Rodgers | 272/97 |
| 4,709,918 | 12/1987 | Grinblat . | |
| 4,714,244 | 12/1987 | Kolomayets et al. | 272/72 |
| 4,743,015 | 5/1988 | Marshall . | |
| 4,798,379 | 1/1989 | Jenkins | 272/70 |
| 4,842,265 | 6/1989 | Kirk | 128/25 R |

FOREIGN PATENT DOCUMENTS

| | | | |
|---|---|---|---|
| 0560622 | 7/1977 | U.S.S.R. | 272/97 |

*Primary Examiner*—Stephen R. Crow

*Attorney, Agent, or Firm*—Gary M. Polumbus

[57] ABSTRACT

An apparatus for closely simulating cross country skiing includes a platform on which right and left foot engaging supports are disposed for reciprocatory sliding movement with right and left hand engaging members being operatively connected to the foot engaging supports to reciprocate in a pattern simulating cross country skiing. A control system is employed for controlling the relative movement of the foot engaging supports and hand engaging members so that a slight amount of play exists between the foot engaging supports permitting a smooth gliding motion. Means are also provided in the control system for allowing the hand engaging members to move twice as fast as the foot engaging supports so that the relative movement between the hand engaging members and foot engaging supports more closely resembles actual cross country skiing.

8 Claims, 3 Drawing Sheets

CROSS COUNTRY SKI EXERCISE APPARATUS

BACKGROUND OF THE INVENTION

1. Field of the Invention

The present invention relates generally to exercise apparatus and more particularly to exercise apparatus that is adapted to simulate cross country skiing.

2. Description of the Prior Art

While many types of devices and apparatus have been developed and utilized through the years for assisting an individual in obtaining desired exercise and particularly cardiovascular exercise, it has only been in recent years that the importance of such exercise has been fully appreciated. As a result, numerous types of equipment have been developed to exercise various parts of the body. In some cases, the equipment is designed to develop muscular strength but in other types of equipment the goal is directed more to cardiovascular benefits and such exercise equipment is commonly referred as aerobic exercise equipment.

Most exercise specialists acknowledge that cross country skiing is one of the best forms of aerobic exercise in that both the arms and the legs are utilized thereby more quickly obtaining an elevated heart rate while obtaining and maintaining good muscle tone throughout the body. For this reason, many types of equipment have been developed in an attempt to simulate cross country skiing so that cross country skiing movements can be performed in an indoor environment.

There have been numerous cross country ski simulating devices developed for indoor use such as for example those illustrated in U.S. Pat. No. 4,659,077 to Stropkay and U.S. Pat. No. 4,434,981 to Norton. The devices disclosed in these two patents include a pair of foot support platforms adapted to guide the feet in a linear reciprocatory manner while independent hand manipulated means are provided for simulating movement of ski poles. In each device, however, there is no operative connection between the foot and hand movements and for that reason the devices have proven difficult to use. Due to the difficulty of coordinating the hand and foot movements, individuals will spend hours and sometimes days trying to learn how to use such an apparatus and in many cases where the apparatus is located in a public exercise facility, the embarrassment will prevent an individual from continuing to use the apparatus.

To avoid the shortcomings of the apparatus disclosed in the Stropkay and Norton patents, cross country ski exercise devices have been developed wherein the movements of the feet and arms are coordinated by mechanical linkage so that as one foot moves rearwardly the associated hand moves forwardly. In fact, in some of these devices, foot supporting platforms themselves are mechanically linked so that as one foot moves rearwardly the other foot moves forwardly. Examples of such devices are shown in U.S. Pat. No. 4,679,786 issued to Rodgers and Canadian Patent No. 490,720 issued to Denison. While the devices disclosed in these patents overcome the coordination problems inherent in the aforenoted patents, it will be appreciated that the exercise motion provided by a device wherein the arms and legs are operatively interconnected for simultaneous movement at equivalent speeds which is biomechanically incorrect and will create a very jerky motion which is not necessarily enjoyable and is difficult to maintain over a long period of time. Further, the jerking movement might cause bodily damage as opposed to a smooth fluid motion which is obtained in natural cross country skiing.

It is to overcome the shortcomings in the prior art devices and to produce a device that more closely resembles cross country skiing that the present invention was developed.

SUMMARY OF THE INVENTION

The cross country ski exercise apparatus or the present invention is adapted to closely simulate natural cross country skiing while being easy to use and having a short learning cycle. The device includes a main frame with a base platform in which are mounted a pair of foot engaging supports and a pair of hand engaging members which in the preferred embodiment are simulated ski poles. The foot engaging supports and hand engaging members are mounted for linear reciprocating movement along predefined slots formed in the base platform.

At one end of the base platform, a plurality of driven and idler pulleys are mounted on transverse shafts and disposed in alignment with one of the foot engaging supports or hand engaging members so as to cooperate with conventional belts that are operatively associated with the pulleys as well as the foot engaging supports and hand engaging members. At the opposite end of the base platform a transverse shaft is provided with an inertial wheel thereon. The common shaft has a pair of one way clutches around which the belts associated with the foot engaging supports pass and also a pair of idler pulleys around which the belts associated with the hand engaging members pass. Through use of the one way clutches, movement of the foot engaging supports cause the transverse shaft to rotate in one direction thereby rotating the inertial wheel so that use of the device is easier on the human body by providing a feeling of continuity and eliminating what would otherwise be a shuffle exercise obtained from the apparatus. Also incorporated into the transverse shaft is a brake mechanism for applying a predetermined resistance to the rotation of the shaft thereby varying the force required and thus the energy exerted by a user of the apparatus to keep the inertial wheel in motion.

Since cross country ski movements require that the hand engaging members move approximately twice as far and twice as fast as the foot engaging supports, the pulley system at one end of the base platform is sized to cause the hand engaging members to move twice as fast as the foot engaging supports thereby permitting the hand engaging members to move twice as far as the foot engaging members in any one stroke. This relationship of the pulleys enables the apparatus of the present invention to more closely simulate cross country skiing than devices that have been provided in the prior art.

Another common distinguishing feature of cross country skiing is that a gliding movement is many times desireable and is obtained by allowing one foot to remain at one end of a stroke while the other foot begins movement in an opposite direction and accordingly the apparatus of the present invention has incorporated therein an asymmetric system for permitting one foot to be delayed in motion while the other foot remains in motion. This feature of the apparatus also permits a smooth transition between forward and rearward movement of the feet and hands thereby eliminating a jerking motion that would result if the asymmetric system were not incorporated into the apparatus.

The apparatus of the present invention further includes an electronic accessory that is not described in detail since such accessories are well known in the prior art, but wherein the resistance to movement of the foot supporting platforms can be regulated in any predetermined manner.

In order to restrain the individual using the apparatus from moving forward during operation of the device, a restraining arm is provided to circumscribe the user's waist thereby holding the individual at a desire location on the apparatus.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENTS

Figure 1:
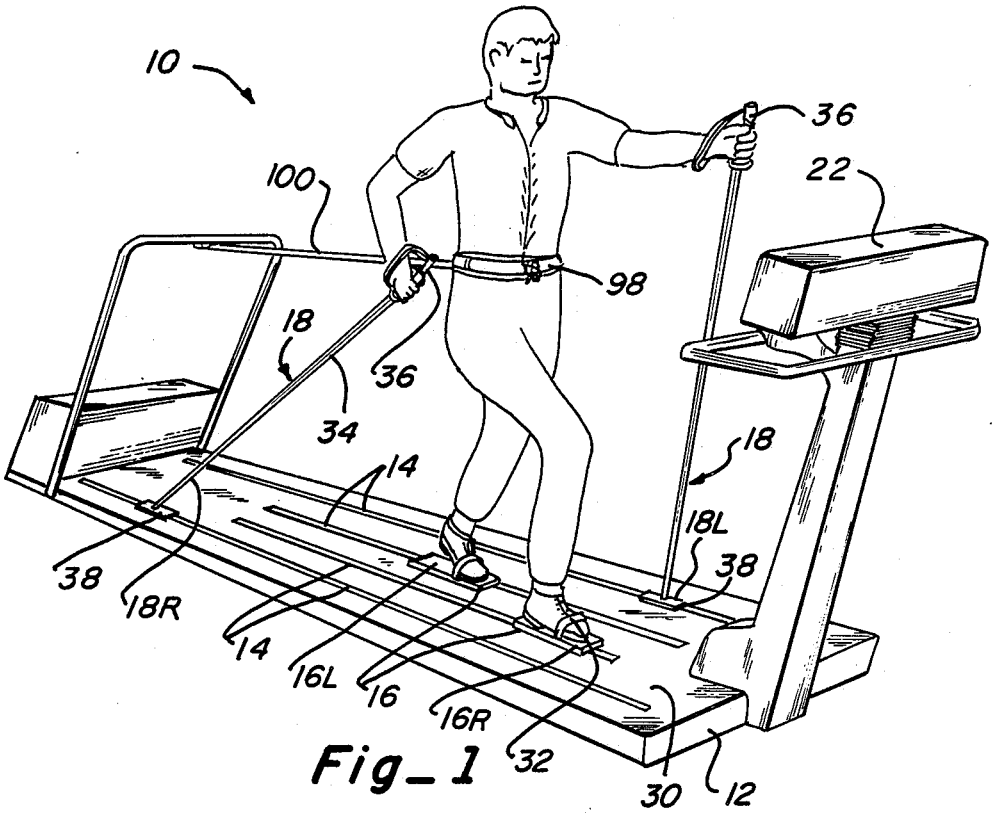
FIG. 1 is a front perspective view of the apparatus of the present invention with an individual positioned on the apparatus illustrating its use.

Referring first to FIG. 1, the cross country ski exercise apparatus 10 of the present invention is shown to include a base platform 12 having a plurality of linear longitudinally extending slots 14 formed in its upper surface, a pair of identical foot engaging supports 16 and a pair of identical hand engaging members 18 in the form of simulated ski poles disposed for reciprocating movement in the linear slots 14. An upright standard 20 is provided at the forward end of the apparatus which includes an electronic display or control box 22, and an inverted U-shaped framework 24 is provided at the rear end of the apparatus supporting a forwardly projecting restraining device 26. A box-like enclosure 28 at the rear end of the base support platform 12 houses operative components of a control system 29 shown best in FIG. 6. An individual using the apparatus is also illustrated in FIG. 1 with his feet supported on the foot engaging supports 16 and his hands gripping the hand engaging members 18 and with the restraining device 26 affixed around his waist to hold him in position when utilizing the apparatus 10.

The base platform 12 is a hollow elongated rectangular box of fairly shallow construction having a top wall 30 in which the linear slots 14 are provided. While not being illustrated, a pair of wear-resistant tracks are preferably positioned along each side of each linear slot so as to provide a long-wear surface on which the foot engaging supports 16 and hand engaging members 18 can ride. Preferably, the foot engaging supports are platforms large enough to accommodate a user's foot having toe straps 32 thereon for temporarily securing the individual's feet to the top surface of the support. The undersurface of the supports has wear resistant pads or roller bearings (not shown) in alignment with the tracks to ride along the tracks, it being appreciated that a low friction, long-wear relationship exists between the undersurface of the foot engaging supports and the tracks upon which they ride.

The hand engaging members 18, which as mentioned previously, are simulated ski poles, include elongated shafts 34 having a grip 36 at the upper end thereof with the lower end of the shaft being secured to a slide member 38 which is similar in construction to a foot engaging support but of smaller construction. In other words, the slide members are supported by the tracks on opposite sides of the associated slots 14 in which they are disposed for reciprocating movement and have roller bearings or a long-wear low friction pad (not shown) thereon which engage the associated tracks.

A portion of each foot engaging support 16 and slide member 38 projects downwardly through an associated slot and is secured to a drive belt 40, 42, 44 or 46 in a conventional manner and for a purpose to become clear hereinafter. Since the particular construction of the foot engaging supports and slide members are not critical features of the invention and since they could be made in numerous manners within the skill of the art, a detailed description thereof is not deemed necessary.

Disposed within the base platform 12, the box enclosure 28, and the upright standard 20, are operative components of the control system 29. The control system includes a belt-pulley system for coordinating the movement of the foot engaging supports 16 and hand engaging members 18 in a predetermined pattern so as to closely simulate natural cross country skiing.

Figure 6:
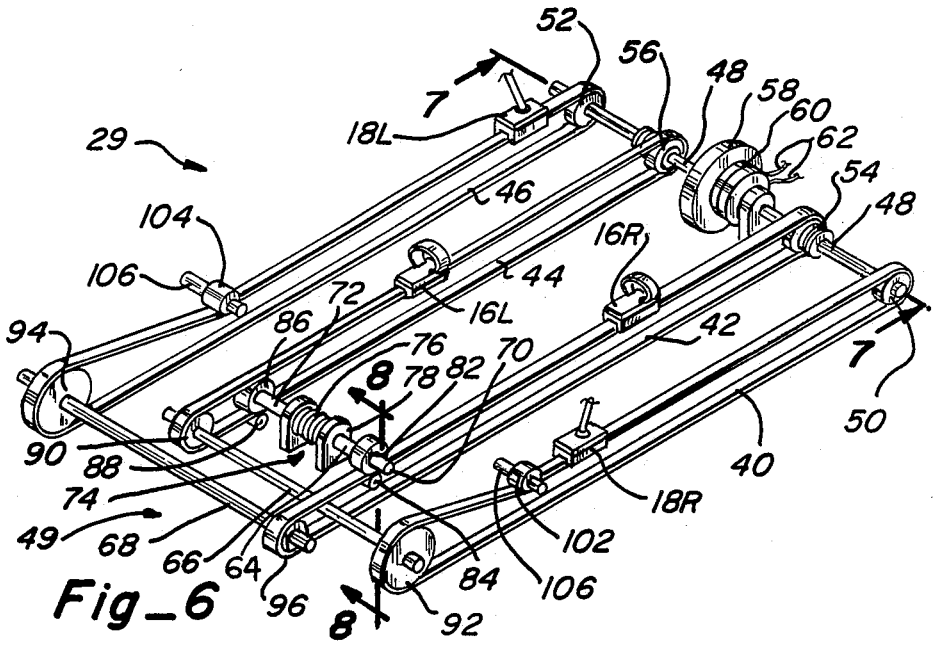
FIG. 6 is a fragmentary perspective view of the operative components of the present invention.
Figure 7:
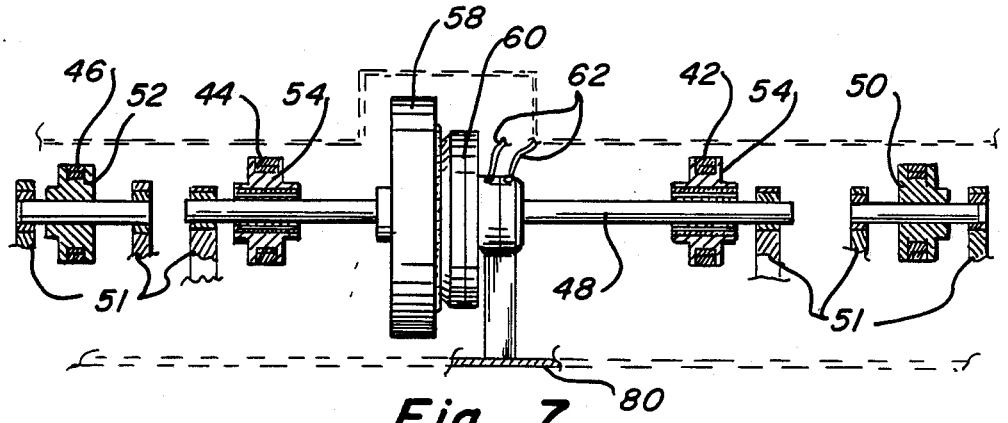
FIG. 7 is an enlarged section taken along line 7—7 of FIG. 6.

The operative components of the control system 29 are probably best illustrated in FIG. 6. It will there be appreciated that the control system includes a transverse inertial shaft 48 at the forward end of the apparatus and a shaft-pulley system 49 at the rear end of the apparatus with the four belts 40, 42, 44 and 46 interconnecting the shaft-pulley system with the common inertial shaft. It will be readily appreciated from the description hereinafter that the inertial shaft and the shaft-pulley system could be reversed and thereby occupy opposite ends of the apparatus and it would not change the operation of the apparatus.

The inertial shaft 48 in the disclosed embodiment is one shaft that is common to each of the four aforenoted belts. The shaft is journaled in suitable bearings 51, so as to span the width of the apparatus at the forward end thereof and so as to lie transversely of the length of the apparatus. The inertial shaft has a pair of idler pulleys 50 and 52 disposed adjacent to its outermost ends, a pair of one way clutches 54 and 56 mounted on the shaft 48 inwardly of the idler pulleys, and an inertial wheel 58 and electronic brake system 60 mounted on the shaft between the one way clutches. The idler pulleys 50 and 52 are associated with the hand engaging members 18 while the one way clutches are associated with the foot engaging supports 16. The idler pulleys do not have to be mounted on the inertial shaft 48 and rather could be mounted on separate shafts. The inertial wheel 58 is conventional in nature and comprises a heavy mass formed into a thin disk that is fixed to the shaft 48 and projects upwardly into the hollow interior of the upright standard 20. The electronic brake is a conventional system adapted to selectively restrict rotation of the shaft 48 and consequently the inertial wheel 58 dependent upon an electrical signal supplied thereto.

The electronic brake is controlled from the electronic control box 22 on the upper end of the upright standard 20 and electrical wiring 62 connects the control box to the electronic brake. It should be appreciated that the resistance to rotation of the shaft can be varied over a timed interval in a well-known manner by varying the intensity of the electrical signal supplied to the electronic brake with a computer or other suitable means. The electrical signal could be varied according to a predetermined program so that the apparatus could be utilized to simulate a given cross country ski trail by providing more resistance to rotation of the shaft 48 wheel to simulate a steep hill and less resistance to stimulate a flat or downhill condition. Since such electronic control systems are available in the art, it will not be described in detail herein.

The one way clutches 54 and 56 are conventional ratchet type mechanisms that are adapted to rotate the common shaft 48 in one direction while being free wheeling relative to the shaft in the opposite direction. For purposes of the present disclosure, the one way clutches are mounted so as to drive the shaft 48 in a counterclockwise direction as viewed in FIG. 6. It will therefore be appreciated that a driving action is imparted to the shaft when the foot engaging supports 16 are moved rearwardly along the base platform 12. Of course, forward movement of a foot engaging support would have no effect on the movement of the shaft 48 since the clutch is free wheeling in this direction relative to the shaft.

As mentioned previously, each foot engaging support 16 and hand engaging member 18 has a belt associated therewith and designated 40, 42, 44 or 46. Belts 40, 44 and 46 are one-sided synchronous tooth belts and pass around the associated idler pulleys or one way clutches on the shaft 48 and extend lengthwise of the apparatus so as to cooperate with the shaft-pulley system 49 at the rear end of the apparatus. Belt 42 is a two-sided synchronous tooth belt and passes around associated pulleys 96 and 82 or one-way clutches and drives the pulley 82. Also as mentioned previously, each foot engaging support and hand engaging member is connected to its associated belt in a conventional manner so as to move in unison with the belt in a reciprocatory pattern. In other words, linear movement of the foot engaging supports and hand engaging members along the slots 14 provided in the base platform cause the underlying and associated belts to reciprocate in a coordinated manner.

The shaft-pulley system 49 has been designed to coordinate movement of the foot engaging supports 16 with the hand engaging members 18 so that as the right foot engaging support 16R moves forwardly, the right hand engaging member 18R moves rearwardly and correspondingly, as the left foot engaging support 16L moves rearwardly and correspondingly and simultaneously, as the left foot engaging support 16L moves rearwardly, the left hand engaging member 18L moves forwardly. This permits movement of the feet and hands in a manner which simulates cross country skiing.

The shaft-pulley system 49 has first, second and third driven shafts 64, 66, and 68 respectively which are mounted in the box like enclosure 28 to extend transversely of the apparatus with the shafts spaced longitudinally of the apparatus at predetermined elevations. The first driven shaft 64 is the most forwardly disposed of the three driven shafts and is journaled in bearings (not shown) at its opposite ends. The first driven shaft is actually bifurcated so as to have right and left segments 70 and 72 respectively with the segments being interconnected by an asymmetrical system 74 which in the disclosed embodiment is a torsion spring 76. The torsion spring is operatively connected to adjacent ends of the right and left segments 70 and 72 respectively so that the spring coils or uncoils upon relative rotational movement between the right and left segments. The torsion spring accordingly permits a slight amount of play between the rotational movements of the segments. Bearing blocks 78 mounted on the bottom wall 80 of the base platform 12 are disposed on either side of the torsion spring to support the adjacent ends of the right and left segments. The right segment 70 has a pulley 82 fixed thereto in alignment with the belt 42 associated with the right foot engaging support 16R so that the upper run of the belt 42 passes along the underside of the pulley 82 and is retained in engagement with the pulley by an idler 84 that is rotatably mounted beneath the pulley 82 to assure adequate wrap of the belt on all drive train pulleys. The idler 84, of course, is mounted on a rotatable shaft that is journaled in suitable bearings that are not shown. The left segment 72 of the first driven shaft has a pulley 86 of identical size to the pulley 82 and is fixed thereto in alignment with the belt 44 associated with the left foot engaging support 16L with the belt 44 passing both across the top and bottom of the pulley 86. An idler 88 is disposed beneath the pulley 86 and in alignment therewith so as to assure adequate wrap of the belt 44 on the driven pulleys. The idler 88 is also mounted on a shaft journaled in suitable bearings that are not shown.

The second driven shaft 66 is disposed immediately rearwardly of the first driven shaft 64 and is journaled in suitable bearings that are not shown. The second driven shaft has a pulley 90, identical in size to those mounted on the first driven shaft, fixed adjacent to the left end thereof and in alignment with the belt 44 associated with the left foot engaging support 16L. The belt 44 wraps around the pulley 90 so as to rotate in unison therewith. The right end of the second driven shaft 66 has a relatively large pulley 92 fixed thereto in alignment with the belt 40 associated with the right hand engaging member 18R with the belt 40 passing around the pulley 92. The relatively large pulley 42 has a diameter of approximately twice that of the pulley 90 on the opposite end of the second driven shaft so that the right hand engaging member 18R which is associated with the larger pulley 92 moves at approximately twice the speed and therefore travels approximately twice the distance in a given period of time as the foot engaging supports 16.

Figure 8:
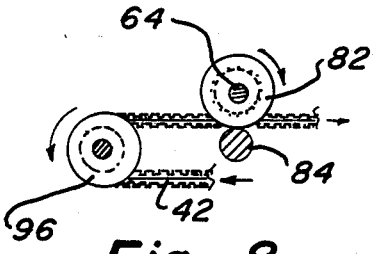
FIG. 8 is a section taken along line 8—8 of FIG. 6.

The third driven shaft 68 is disposed immediately rearwardly of the second driven shaft 66 and has its opposite ends journaled in bearing members which are not shown. The third driven shaft has a pulley 94 fixed to its left end in alignment with the belt 46 associated with the left hand engaging member 18L with the belt 46 passing around the pulley 94. The pulley 94 is identical in size to the pulley 92 on the right end of the second driven shaft 66 thereby causing the left hand engaging member 18L to move at the same speed and travel the same distance in a given period of time as the right hand engaging member 18R. The right end of the third driven shaft 68 has a pulley 96 identical in size to those mounted on the first driven shaft 64 and is fixed to the third driven shaft in alignment with the belt 42 associated with the right foot engaging support 16R. The belt 42 passes around the pulley 96. The relationship of the pulley 96, the pulley 82 and the idler 84 thereunder is illustrated in FIG. 8. It will therein be appreciated that the pulley 82 on the right segment 70 of the first driven shaft 64 is caused to rotate in an opposite direction from the pulley 96 on the right side of the third driven shaft 68.

From the above description, it can be seen that each of the foot engaging supports 16 and the hand engaging members 18 are tied together through the belt and pulley system to move in a synchronized and prearranged relationship so that the right foot engaging support and left hand engaging member move forwardly and rearwardly together while the left foot engaging support and the right hand engaging member move forwardly and rearwardly together. However, as mentioned previously, the hand engaging members move at approximately twice the speed and thus travel approximately twice the distance in a given period of time as the foot engaging member so as to closely resemble what actually takes place in natural cross country skiing. In other words, when the right foot is making a single rearward stroke of motion, the left hand is making the same rearward stroke but the stroke is approximately twice as long and moves twice as fast. The same is true of the left foot and right hand so that with the apparatus of the present invention, cross country skiing can be very closely simulated.

Figure 3:
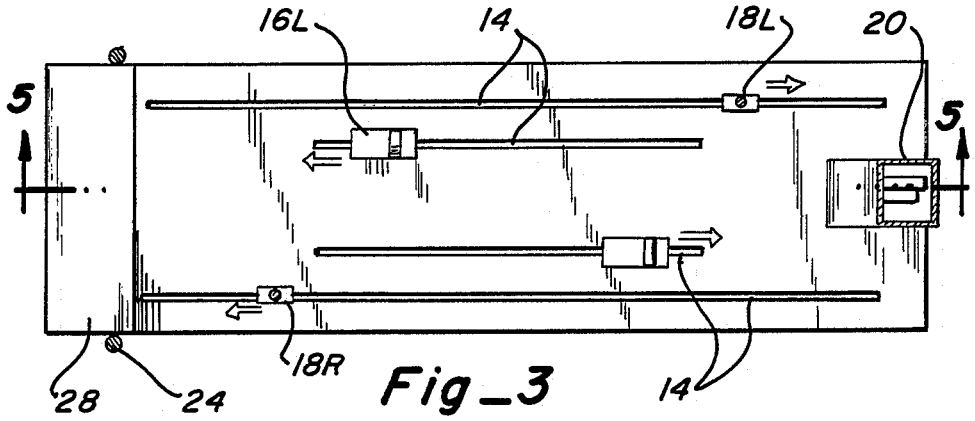
FIG. 3 is a section taken along line 3—3 of FIG. 2.
Figure 4:
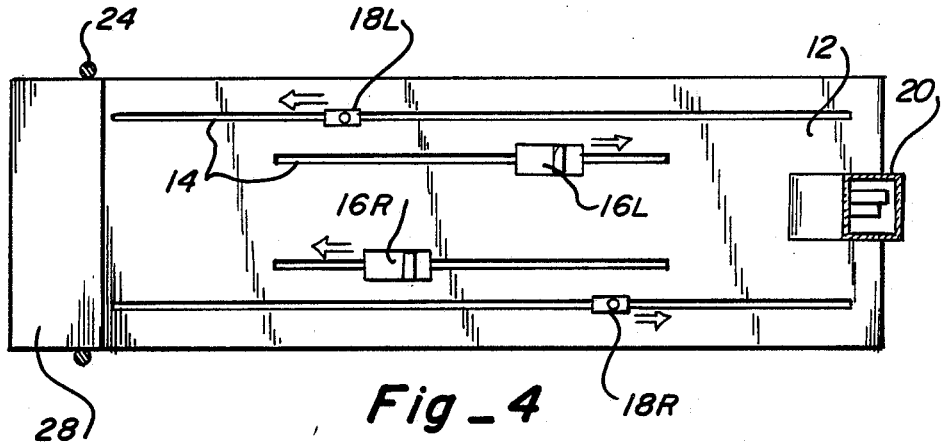
FIG. 4 is a view similar to FIG. 3 showing the foot engaging supports and hand engaging members in different positions from that illustrated in FIG. 3.
Figure 5:
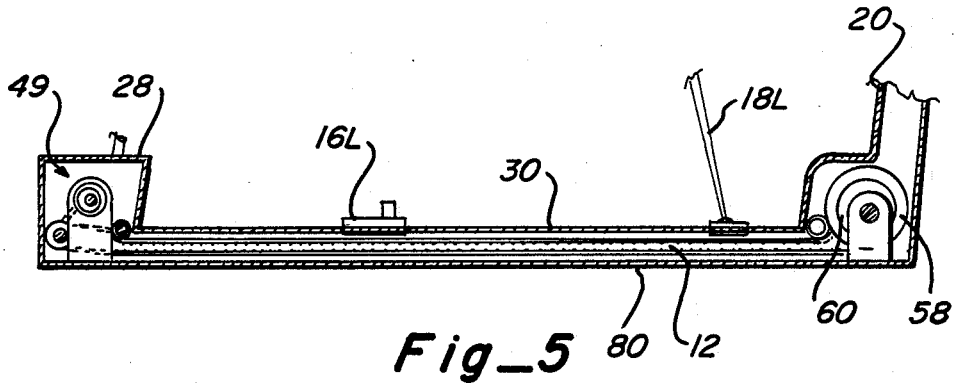
FIG. 5 is a section taken along line 5—5 of FIG. 3.

With reference to FIGS. 3 and 4, the relative positions of the foot engaging supports 16 and hand engaging members 18 are illustrated at two different times. From these views it can be seen how the left foot engaging support 16L and right hand engaging member 18R move forwardly and rearwardly together while the right foot engaging support 16R and left hand engaging member 18L move forwardly and rearwardly together.

Figure 2:
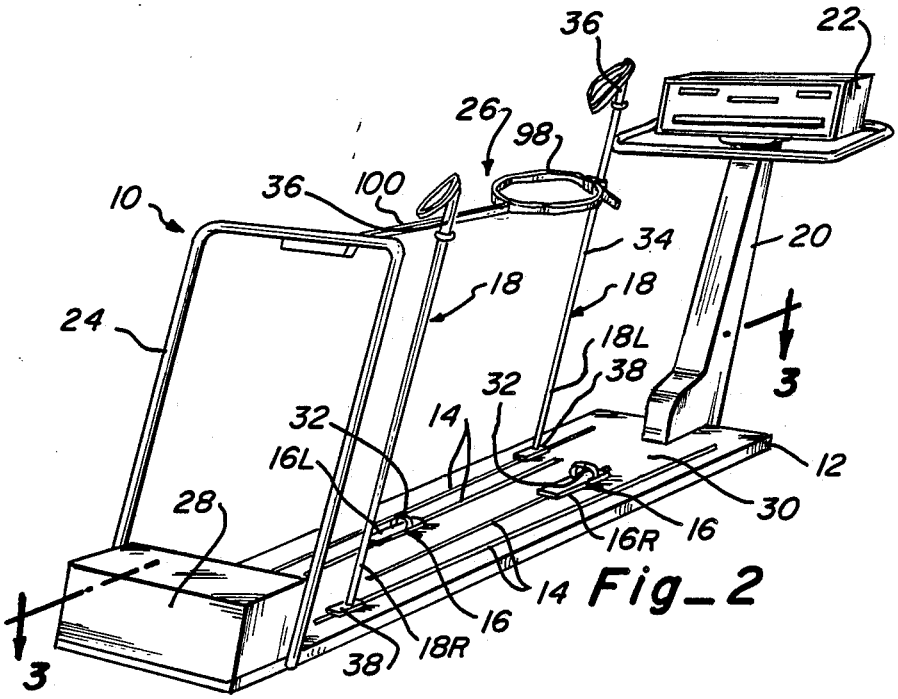
FIG. 2 is a rear perspective of the apparatus shown in FIG. 1.

The body restraining device 26 (FIGS. 1 and 2) could take different forms but in the disclosed embodiment, it comprises a rigid forward extension from the inverted U-shaped framework 24 on the rear end of the apparatus 10 with the forward end of the restraining device having a loop 98 which could be made from two pivotally connected semicircular segments that pivot outwardly relative to each other to allow an individual to step into the loop and then can be closed around the waist and secured together in any suitable manner. The loop 98 is supported on a rigid horizontally disposed bar 100. It will be appreciated that when using the device there is a tendency for the user's body to move forward since there is resistance to rearward movement of the foot engaging supports 16 through the common inertial shaft 48. The body restraining device 26 thereby prevents the user from moving forward or straying from a centered location on the apparatus so that the slots 14 in the base support 12 provide an adequate range of use when a user take full strides as would be required to closely simulate cross country skiing.

The asymmetric system 74 which in the preferred embodiment takes the form of the torsion spring 76 provides a delay means in the first driven shaft 64 so that a slight amount of play is permitted between the right and left foot engaging supports. This permits a smooth transition between forward and rearward movement of the foot engaging supports and consequently the hand engaging members and permits a slight degree of delayed motion which would simulate gliding in actual cross country skiing. It would further permit the device to be used without a jerking motion as would exist if the asymmetric system 74 were not provided since an abrupt change between forward and rearward movement would be required simultaneously with each foot engaging support. This abrupt change is prevented through use of the asymmetrical system since it permits nonuniform but closely related rotation between the right and left segments 70 and 72 respectively of the first driven shaft.

A pair of tensioning idlers 102 and 104 are provided on transversely disposed shafts 106 which are journaled in bearings (not shown) with the idlers 102 and 104 engaging the upper surface of the belts 40 and 46 associated with the right and left hand engaging members 18R and 18L respectively. These idlers are provided to retain a desired tension in the belts in a conventional manner.

Although the present invention has been described with a certain degree of particularity, it is understood that the present disclosure has been made by way of example, and changes in detail or structure may be made without departing from the spirit of the invention, as defined in the appended claims.

We claim:

1. An exercise apparatus comprising in combination:

a. a framework, b. a pair of foot-engaging supports mounted on said framework for reciprocal movement, c. a pair of hand-engaging members, each being mounted on said framework and being individually associated with one of the foot-engaging supports for reciprocal movement, and d. a control system mounted on said framework and operably interconnecting said foot-engaging supports with said hand-engaging members whereby associated foot-engaging supports and hand-engaging members are moved in opposite directions, said control system being a belt and pulley system having one way clutches mounted on a shaft with each foot-engaging support being associated with a one-way clutch and each foot-engaging support and hand-engaging member being associated with a belt forming a part of the belt and pulley system, said belt and pulley system further including a second shaft having a pair of pulleys fixed thereto with each pulley of the pair being associated with and operatively connected to a foot-engaging support, and delay means for permitting one foot-engaging support to move while the other foot-engaging support temporarily remains at a point of transition in its direction of movement, said delay means including an asymmetrical system operatively forming a part of said second shaft to permit a limited degree of relative movement between the pulleys and the associated foot-engaging supports connected thereto.

2. The apparatus of claim 1 wherein said asymmetrical system is a torsion spring dividing the second shaft into two segments with each one of the pair of pulleys being associated with one of the shaft segments.

3. An exercise apparatus comprising in combination:

a. a framework, b. a pair of foot-engaging supports mounted on said framework for reciprocal movement, c. a pair of hand-engaging members mounted on said framework for reciprocal movement, and d. a control system mounted on said framework and operably interconnecting said foot-engaging supports with said hand-engaging members to control the movements of said supports and members, said control system including a common shaft having an inertial wheel fixedly connected thereto and at least one driving one-way clutch mounted on the common shaft to rotate the common shaft in one direction, a system of shafts and interconnected pulleys including a fixed pulley associated with each of said hand-engaging members and foot-engaging supports, the fixed pulleys associated with said hand-engaging members being larger than the fixed pulleys associated with the foot-engaging supports so that the hand engaging members will reciprocate at a faster speed than the foot-engaging supports, and a belt system operatively interconnecting the system of shafts and interconnected pulleys and the one-way clutch to predictably control movement of the foot-engaging supports and hand-engaging members.

4. The apparatus of claim 3 further including brake means for selectively restricting rotative movement of said common shaft.

5. The apparatus of claim 4 wherein said brake means is an electronic brake.

6. The apparatus of claim 3 wherein said hand engaging members include elongated poles simulating a ski pole.

7. The apparatus of claim 3 wherein said framework has a first end and a second end and wherein said common shaft is disposed at the first end and said system of shafts and interconnected pulleys is disposed at said second end.

8. An exercise apparatus comprising in combination:

a. a framework, b. a pair of foot-engaging supports mounted on said framework for reciprocal movement, c. a pair of hand-engaging members mounted on said framework for reciprocal movement, and d. a control system mounted on said framework and operably interconnecting said foot-engaging supports with said hand-engaging members to control the movements of said supports and members, said control system including a common shaft having an inertial wheel fixedly connected thereto and two driving one-way clutches mounted on the common shaft to rotate the common shaft in one direction, a pair of idler pulleys mounted on said common shaft being operatively connected to said hand-engaging members, a system of shafts and interconnected pulleys including a plurality of fixed pulleys connected to a plurality of shafts with each fixed pulley being associated with one of said foot-engaging supports and hand-engaging members, the fixed pulleys associated with each one of said hand-engaging members being larger in diameter than the fixed pulley associated with the foot-engaging supports whereby the hand-engaging members are reciprocally moved at a faster speed than the foot-engaging supports, and a belt system operatively interconnecting the system of shafts and interconnected pulleys and the one-way clutches to predictably control movement of the foot-engaging supports and hand-engaging members, said belt system including a belt associated with each one of said foot-engaging supports and hand-engaging members.

* * * * *